US009768561B2

(12) United States Patent
Hsu

(10) Patent No.: US 9,768,561 B2
(45) Date of Patent: Sep. 19, 2017

(54) CABLE CONNECTOR AND METHOD OF ASSEMBLING THE SAME

(71) Applicant: Yong Tai Electronic(DONGGUAN) Ltd., Dongguan (CN)

(72) Inventor: Chingjen Hsu, Dongguan (CN)

(73) Assignee: YONG TAI ELECTRONICS(DONGGUAN) LTD., Dongguan (CN)

( * ) Notice: Subject to any disclaimer, the term of this patent is extended or adjusted under 35 U.S.C. 154(b) by 0 days.

(21) Appl. No.: 15/403,366

(22) Filed: Jan. 11, 2017

(65) Prior Publication Data

US 2017/0207582 A1 Jul. 20, 2017

(30) Foreign Application Priority Data

Jan. 14, 2016 (CN) ..... 2016 2 0040758 U

(51) Int. Cl.

| | |
|---|---|
| ***H01R 13/648*** | (2006.01) |
| ***H01R 13/66*** | (2006.01) |
| ***H01R 24/60*** | (2011.01) |
| ***H01R 12/51*** | (2011.01) |
| ***H01R 13/405*** | (2006.01) |
| ***H01R 43/20*** | (2006.01) |
| ***H01R 43/24*** | (2006.01) |

(52) U.S. Cl.

CPC ..... *H01R 13/665* (2013.01); *H01R 12/515* (2013.01); *H01R 13/405* (2013.01); *H01R 24/60* (2013.01); *H01R 43/205* (2013.01); *H01R 43/24* (2013.01)

(58) Field of Classification Search

CPC ..... H01R 24/60; H01R 13/6466; H01R 13/6581; H01R 13/658; H01R 13/6585

USPC ..... 439/607.1, 607.05, 660, 676

See application file for complete search history.

(56) References Cited

U.S. PATENT DOCUMENTS

| | | | | |
|---|---|---|---|---|
| 5,658,170 | A * | 8/1997 | Tan | H01R 9/034 439/607.41 |
| 2015/0270659 | A1* | 9/2015 | Kao | H01R 24/64 439/607.01 |
| 2015/0303629 | A1* | 10/2015 | MacDougall | H01R 13/6581 439/607.01 |
| 2015/0333451 | A1* | 11/2015 | Kao | H01R 24/60 439/607.01 |

(Continued)

*Primary Examiner* — Abdullah Riyami
*Assistant Examiner* — Thang Nguyen
(74) *Attorney, Agent, or Firm* — WPAT, PC

(57) ABSTRACT

A cable connector and method of assembling the same is disclosed. The cable connector comprises a conductive body including an insulative housing and a plurality of terminals, a mating port being defined in the front of the conductive body, and the mating connector being plugged into the mating port; a front shell surrounding the conductive body; a cover being fastened with the front shell, wherein, a cable assembly including a plurality of wires and a rear insulative housing, the wires being electrically connecting with the terminals, the rear insulative housing being insert-molded in a cavity formed by the cover. The rear insulative housing is insert-molded in the cavity formed by the cover, thus the cable connector has a simpler structure. Besides, the cover is fastened with the front shell, with no need to be soldered with each other, which results a simplified manufacturing process to reduce the cost.

14 Claims, 5 Drawing Sheets

(56) References Cited

U.S. PATENT DOCUMENTS

| | | | | |
|---|---|---|---|---|
| 2016/0056583 | A1* | 2/2016 | Chuang | H01R 13/6581 439/607.01 |
| 2016/0064868 | A1* | 3/2016 | Little | H01R 13/6581 439/607.01 |
| 2016/0079714 | A1* | 3/2016 | Wu | H01R 13/6585 439/607.05 |
| 2016/0141804 | A1* | 5/2016 | Kao | H01R 24/60 439/607.01 |
| 2016/0149345 | A1* | 5/2016 | Liu | H01R 13/6581 439/607.01 |
| 2016/0172791 | A1* | 6/2016 | Fan | H01R 13/6585 439/607.05 |

* cited by examiner

CABLE CONNECTOR AND METHOD OF ASSEMBLING THE SAME

CROSS REFERENCE TO RELATED APPLICATIONS

This application claims the benefit of priority to Chinese patent application Ser. No. 201620040758.2 entitled "CABLE CONNECTOR", filed Jan. 14, 2016, which is also incorporated herein by reference.

BACKGROUND OF THE INVENTION

1. Field of the Invention

The present invention pertains to a cable connector and method of assembling the same, and particularly relates to a cable connector for electrically connecting to a mating connector thereof.

2. Description of Related Art

USB (Universal Serial Bus) connectors are widely used in different electric devices. USB TYPE C with new specification is issued by USB 3.0 Promoter Group to meet the development of miniaturization and multi-function of the electric devices. Chinese Pat. No. 201420690153.9 shows a USB TYPE C connector, the structure of the cable connector is so complicated that it is not easily manufactured.

Therefore, there is a desire to invent an improved cable connector to offer advantages over the related art.

SUMMARY OF THE PRESENT INVENTION

Accordingly, the object of the present invention is to provide a cable connector having simple structure to be easily manufactured and method of assembling the same.

To achieve the above-mentioned object, a cable connector for electrically connecting with a mating connector is provided. The cable connector comprise a conductive body including an insulative housing and a plurality of terminals, a mating port being defined in the front of the conductive body, and the mating connector being plugged into the mating port; a front shell surrounding the conductive body; a cover being fastened with the front shell, wherein, a cable assembly including a plurality of wires and a rear insulative housing, the wires being electrically connecting with the terminals, the rear insulative housing being insert-molded in a cavity formed by the cover.

The rear insulative housing is insert-molded in the cavity formed by the cover, thus the cable connector has a simpler structure. Besides, the cover is fastened with the front shell, with no need to be soldered with each other, which results a simplified manufacturing process to reduce the cost.

Other objects, advantages and novel features of the invention will become more apparent from the following detailed description when taken in conjunction with the accompanying drawings.

DETAILED DESCRIPTION OF THE INVENTION

Reference will now be made in detail to a preferred embodiment of the present invention.

Figure 1:
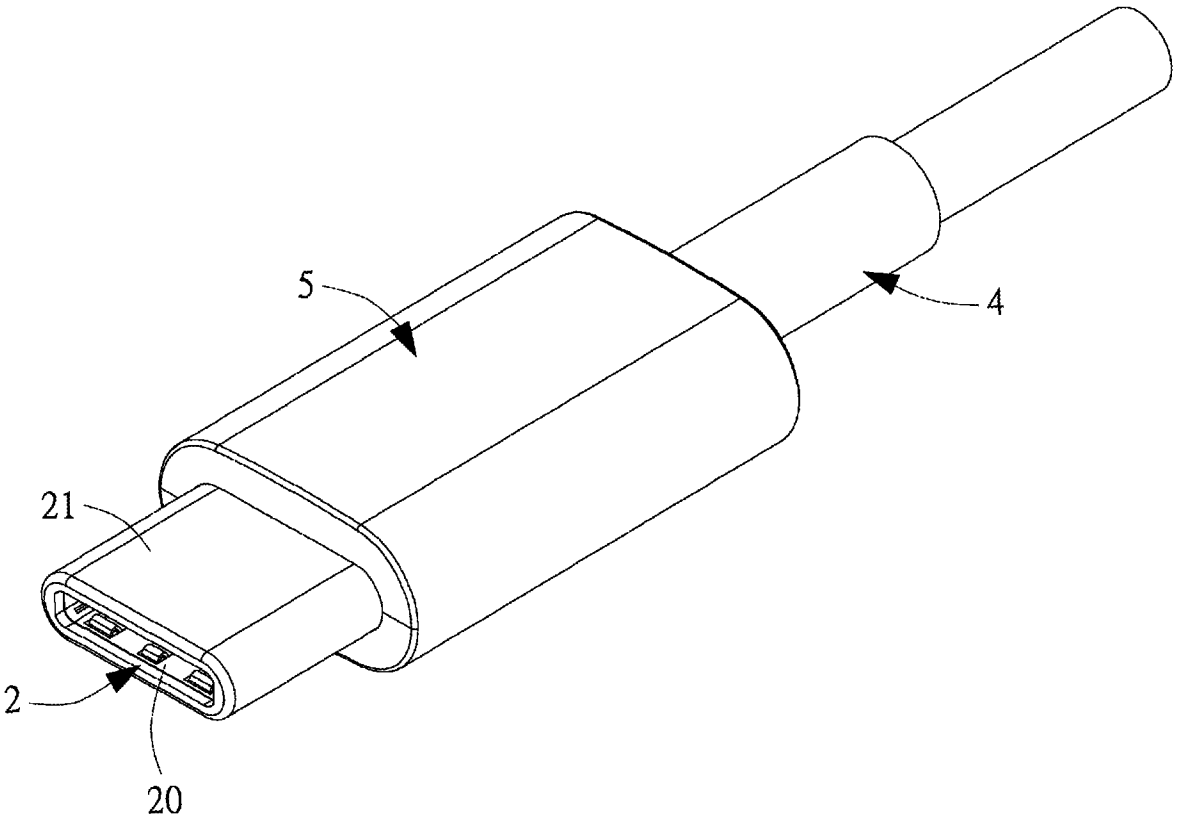
FIG. 1 depicts an assembled perspective view of a cable connector in accordance with the present invention.
Figure 2:
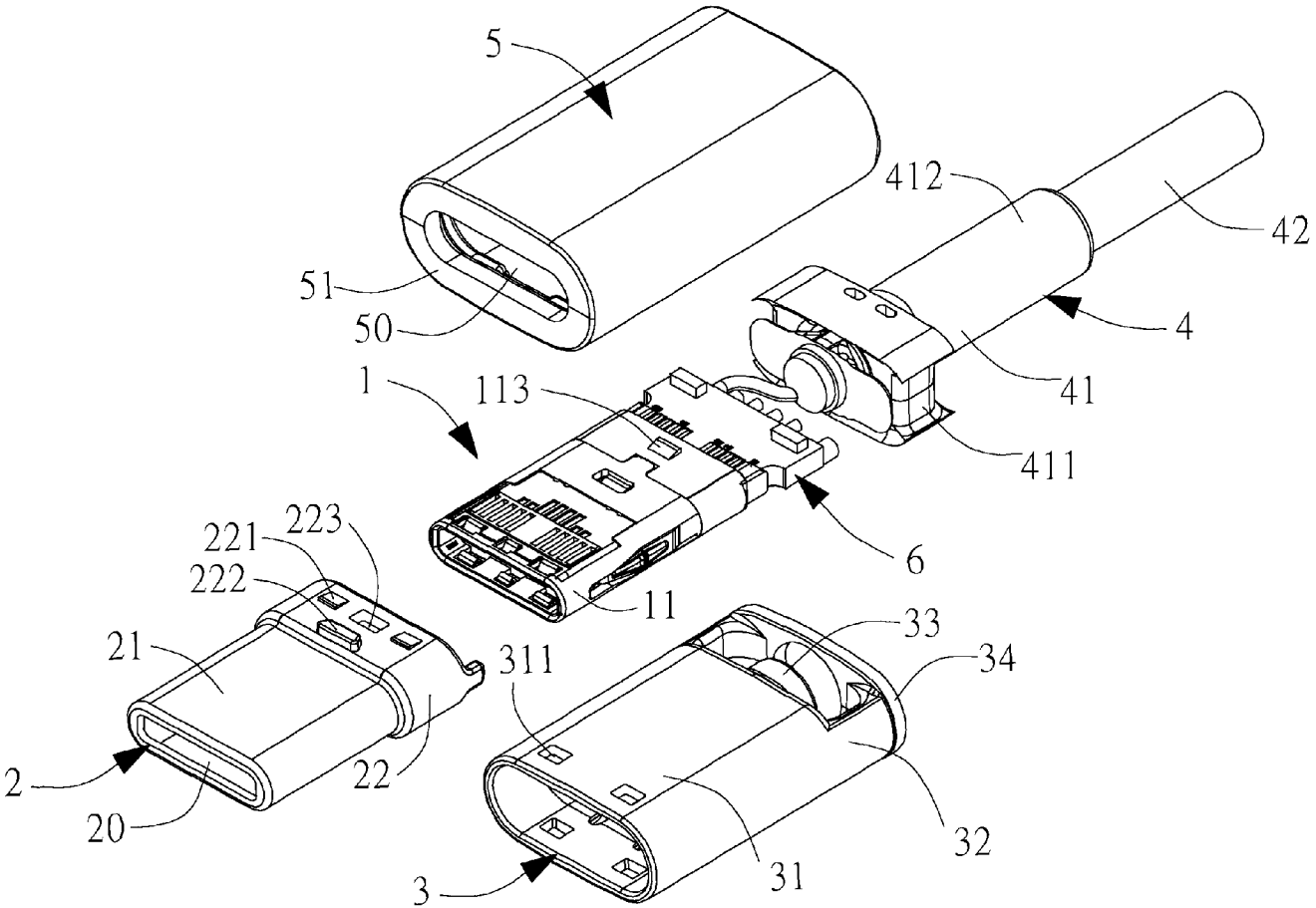
FIG. 2 depicts an exploded view of the cable connector in FIG. 1.

In order to better appreciate and understand the present invention, reference is first made to FIGS. 1-2, which are assembled perspective views and exploded views, respectively, of a cable connector according to an embodiment of the present invention. The cable connector of the present invention is electrically connecting with a mating connector (not shown). The cable connector includes a conductive body 1, a front shell 2 which is surrounded around the conductive body 1, a cover 3 which is positioned with the front shell 2, a cable assembly 4 which is electrically connecting with the conductive body 1, an outer shell 5 which is surrounded around the cover 3, and a printed circuit board 6 which is respectively connecting with the conductive body 1 and the cable assembly 4.

Figure 3:
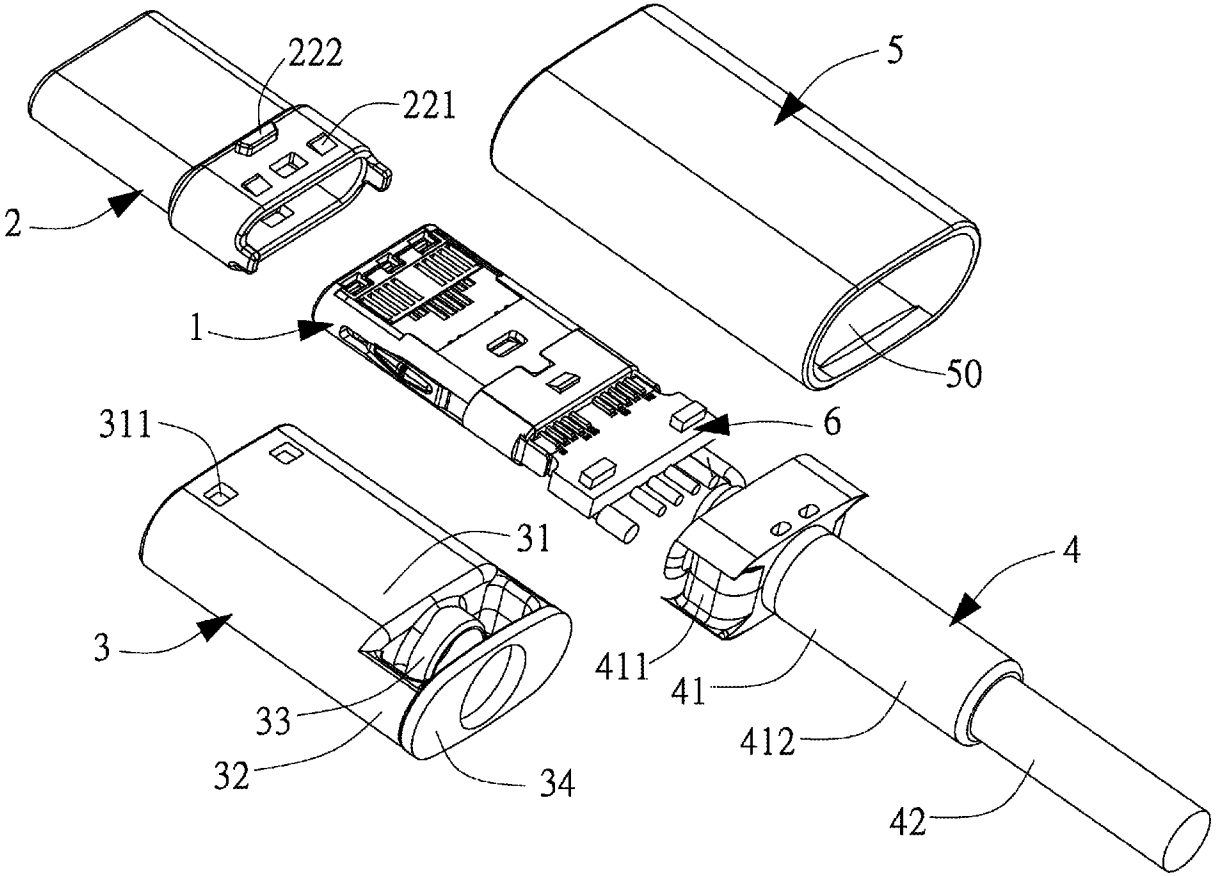
FIG. 3 depicts another exploded view of the cable connector in FIG. 1.

FIG. 3 shows another exploded view of the cable connector. The conductive body 1 includes an insulative housing 11 and a plurality of terminals (not figured) disposed in the insulative housing 11. A block 113 is extended from the top surface and the bottom surface of the insulative housing 11 as in FIG. 2. Each of the terminals (not figured) has a contacting portion (not figured) for contacting with the mating connector (not shown). Each of the terminals (not figured) has a tailing portion (not figured) for contacting with the printed circuit board 6.

The front shell 2 is surrounded around the conductive body 1, a mating port 20 is defined in the front of the conductive body 1, a tongue of the mating connector (not shown) is plugged into the mating port 20. The front shell 2 includes a front portion 21 and a fastening portion 22, a slope (not figured) is defined between the front portion 21 and the fastening portion 22. A pair of buckling portions 221 are respectively defined on the top surface and the bottom surface of the fastening portion 22, a limiting portion 222 is respectively defined on the top surface and the bottom surface of the fastening portion 22, and the limiting portion 222 is nearer to the mating port 20. A fixing hole 223 is located between the two buckling portions 221, the block 113 matches with the fixing hole 223.

The front of the cover 3 is positioned with the end of the front shell 2. The cover 3 includes a main body 31, two side portions 32, a neck portion 33 and a rear portion 34. Two side portions 32 extend backwards from both sides of the main body 31, the neck portion 33 extends backwards from the middle of the main body 31, the neck portion 33 is in the shape of circular tube. The neck potion 33 is defined between two side portions 32, the rear portion 34 connects two side portions 32 and is substantially vertical to the neck portion 33. A pair of buckling holes 311 are respectively defined on the top surface and the bottom surface of the main body 31 of the cover 3, the buckling portion 221 cooperates with the buckling holes 311 to be positioned.

Figure 4:
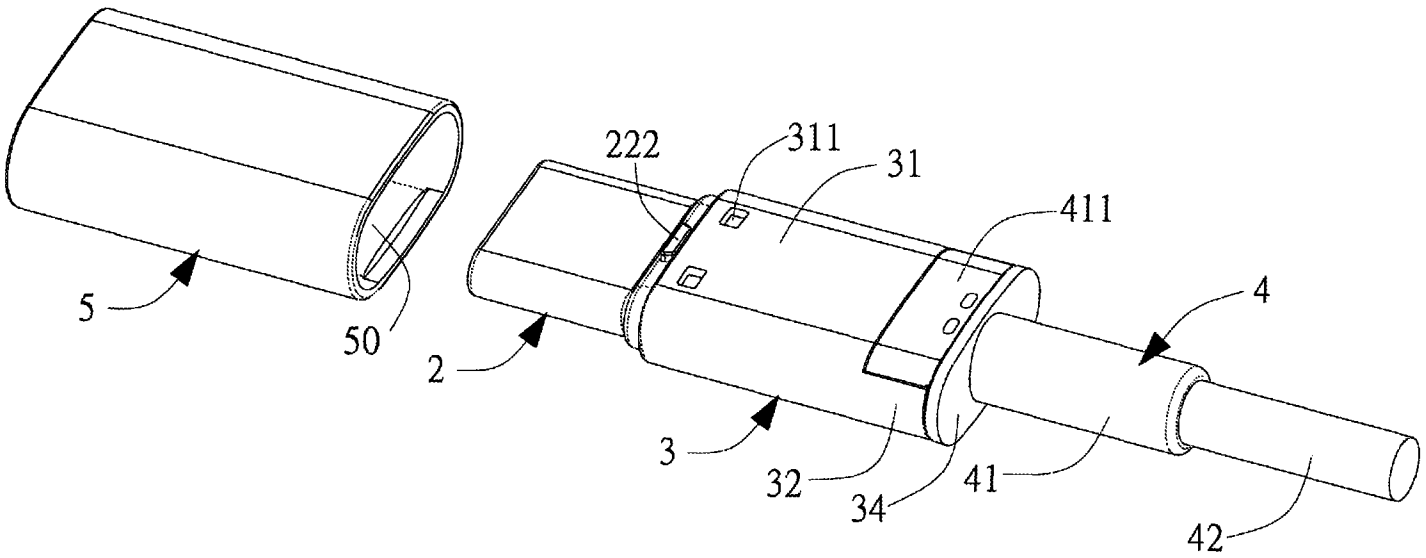
FIG. 4 is a further partially exploded view of the cable connector in FIG. 2.
Figure 5:
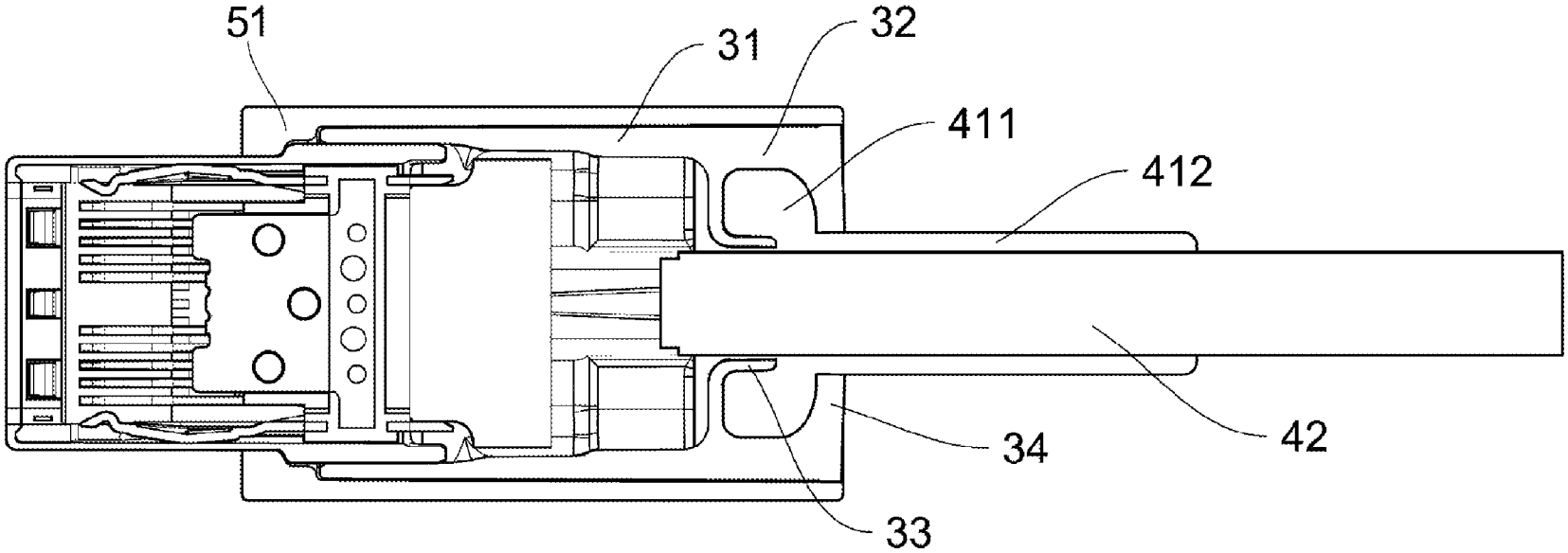
FIG. 5 depicts a cross-sectional view of the cable connector in FIG. 1.

In this embodiment, referring to FIGS. 4-5, the cable assembly 4 is insert-molded with the cover, the cable assembly 4 includes a plurality of wires 42 and a rear insulative housing 41. The wires 42 pass through the neck portion 33 and a hole (not figured) defined on the rear portion 34 to be soldered on the printed circuit board 6. The wires 42 indirectly connect with the terminals (not figured) via the printed circuit board 6. The rear insulative housing 41 is insert-molded in the cavity formed by the cover 3, the cavity includes but not limited to the space between the main body 31 and the rear portion 34. The rear insulative housing 41 encircles the wires 42 to form a strain relief. The rear insulative housing 41 includes a head portion 411 and a tail portion 412 which are attached to the wires. The tail portion 412 extends backwards from the head portion 411 to pass through the hole (not figured) of the rear portion 34. The head portion 411 is insert-molded in the space defined by the main body 31, the side portion 32 and the rear portion. The top surface of the head portion 411 and the top surface of the main body 31 of the cover 3 is substantially on the same level, same as the bottom surface. The rear contacts (not figured) of the printed circuit board 6 are respectively connecting with the wires 42.

It is worthwhile mentioning that, in this embodiment, the cavity further includes an inner chamber defined by the main body 31, the rear insulative housing 41 is insert-molded in the inner chamber.

The outer shell 5 made of zinc alloy is made by die-casting or metal injection. A receiving space 50 is defined by the outer shell 5 from the front to backwards. A covering portion 51 is extended inwardly from the front of the outer shell 5. The inner shape of the covering portion 51 conforms with the outer shape of the front shell 2. No slit is formed between the outer shell 5 and the front shell 2 after the outer shell 5 is assembled.

The front shell 2 and the cover 3 made of zinc alloy is made by die-casting or metal injection. The buckling portion 221 and the limiting portion 222 are insert-molded with the front shell 2, the buckling holes 311 is inert molded with the cover 3.

The printed circuit board is surrounded by the cover 3. A plurality of front contacts (not figured) and the rear contacts (not figured) are arranged on the printed circuit board 6. The front contacts (not figured) and the rear contacts (not figured) are respectively connecting with the terminals (not figured) and the wires 42.

Please refer to FIGS. 3 to 5, a method of assembling the cable connector above comprises the steps of:

1. Providing the conductive body 1, the cover 3, the front shell 2, the outer shell 5, the cable assembly 4 and the printed circuit board 6.

2. Electrically connecting the cable assembly 4 with the rear contacts (not shown) of the printed circuit board 6, electrically connecting the front contacts (not shown) of the printed circuit board 6 with the conductive body 1.

3. Assembling the front shell 2 around the periphery of the conductive body 1, the block 113 matches with the fixing hole 223.

4. Fastening the cover 3 to the front shell 2, the front of the cover 3 leans against the limiting portion 22, the buckling portion 221 is fastened into the buckling holes 311.

5. The rear insulative housing 41 is insert-molded between the main body 31 and the rear portion 34 of the cover 3, so that it is matched seamless.

6. Assembling the outer shell 5 onto the periphery of the cover 3 from the direction of the mating port 20, eventually, the assembling of the cable connector is finished.

Above all, the rear insulative housing 41 is insert-molded in the cavity formed by the cover 3, thus the cable connector has a simpler structure. Besides, the cover 3 is fastened with the front shell 2, with no need to be soldered with each other, which results a simplified manufacturing process to reduce the cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector for electrically connecting with a mating connector, comprising:

a conductive body including an insulative housing and a plurality of terminals, a mating port being defined in the front of the conductive body, and the mating connector being plugged into the mating port;

a front shell surrounding the conductive body;

a cover being fastened with the front shell, wherein, a cable assembly including a plurality of wires and a rear insulative housing, the wires being electrically connecting with the terminals, the rear insulative housing being insert-molded in a cavity formed by the cover, the cover includes a main body, two side portions and a rear portion, the side portions extend backwards from two sides of the main body, the rear portion connects with the two side portions, the wires pass through the rear portion, and the rear insulative housing is insert-molded between the main body and the rear portion.

2. The cable connector according to claim 1, wherein the cover further includes a neck portion, the neck portion extends backwards from the middle of the main body, the neck potion is defined between the two side portions, and the rear portion is substantially vertical to the neck portion.

3. The cable connector according to claim 1, wherein the rear insulative housing includes a head portion and a tail portion, the tail portion and the head portion surround the wires, the neck portion passes through the rear portion, and the head portion is insert-molded in the cavity defined by the main body, the side portions and the rear portion.

4. The cable connector according to claim 3, wherein the top surface of the head portion and the top surface of the main body of the cover are substantially on the same level.

5. The cable connector according to claim 1, wherein the cavity further includes an inner chamber defined by the main body, and the rear insulative housing is insert-molded in the inner chamber.

6. The cable connector according to claim 1, further including an outer shell, wherein the outer shell is assembled to the periphery of the cover from the mating port, the front of the outer shell is bended inwardly to form a covering portion, and the inner shape of the covering portion conforms with the shape of the front shell.

7. The cable connector according to claim 1, further including a printed circuit board, wherein the printed circuit board is surrounded by the cover, a plurality of front contacts and a plurality of rear contacts are arranged on the printed circuit board, and the front contacts and the rear contacts are respectively connecting with the terminals and the wires.

8. The cable connector according to claim 1, wherein the front shell includes a front portion and a fastening portion, two pairs of buckling portions are respectively defined on the top surface and the bottom surface of the fastening portion, two limiting portions are respectively defined on the top surface and the bottom surface of the fastening portion, and the limiting portion is nearer to the mating port.

9. The cable connector according to claim 8, wherein the front of the cover leans against the limiting portion, a pair of buckling holes are respectively defined on the top surface and the bottom surface of the cover, and the buckling portion cooperates with the buckling holes to be positioned.

10. A method of assembling a cable connector, comprising the steps of:

(a) providing a conductive body, a cover, a front shell, an outer shell, a cable assembly and a printed circuit board, the conductive body including an insulative housing and a plurality of terminals, a block is extended from the insulative housing, a pair of buckling portions are respectively defined on the front shell, a fixing hole is located between the two buckling portions, the block matches with the fixing hole;

(b) electrically connecting the cable assembly with the printed circuit board, electrically connecting the printed circuit board with the conductive body;

(c) assembling the front shell around the periphery of the conductive body;

(d) fastening the cover to the front shell;

(e) assembling the outer shell onto the periphery of the cover;

(f) insert-molding the cable assembly with the cover.

11. The method according to claim 10, wherein a pair of buckling holes are respectively defined on a top surface and a bottom surface of the cover, the buckling portion is fastened into the buckling holes.

12. The method according to claim 10, wherein two limiting portions are respectively defined on a top surface and a bottom surface of the front shell, the front of the cover leans against the limiting portion.

13. The method according to claim 10, wherein the cable assembly includes a plurality of wires and a rear insulative housing, the wires are electrically connecting with the terminals, the rear insulative housing is insert-molded in the cavity formed by the cover.

14. The method according to claim 13, wherein the cover includes a main body, two side portions and a rear portion, the side portions extend backwards from two sides of the main body, the rear portion connects with the side portions, the wires pass through the rear portion, the rear insulative housing is insert-molded between the main body and the rear portion.

* * * * *